US006353163B2

(12) United States Patent
Suzuki

(10) Patent No.: US 6,353,163 B2
(45) Date of Patent: Mar. 5, 2002

(54) FALLBOARD ARRANGEMENT FOR KEYBOARD INSTRUMENT

(75) Inventor: Akihiro Suzuki, Shizuoka-ken (JP)

(73) Assignee: Kabushiki Kaisha Kawai Gakki Seisakusho, Hamamatsu (JP)

( * ) Notice: Subject to any disclaimer, the term of this patent is extended or adjusted under 35 U.S.C. 154(b) by 0 days.

(21) Appl. No.: 09/843,952

(22) Filed: Apr. 30, 2001

(30) Foreign Application Priority Data

May 8, 2000 (JP) ..... 2000-134963

(51) Int. Cl.[7] ..... G10C 3/02

(52) U.S. Cl. ..... 84/179

(58) Field of Search ..... 84/179, 178, 177, 84/174, 187, 192; D17/20, 99

(56) References Cited

U.S. PATENT DOCUMENTS 5,175,386 A * 12/1992 Kuwahara ..... 84/179
6,130,371 A * 10/2000 Inoue ..... 84/179

* cited by examiner

*Primary Examiner*—Jeffrey Donels
*Assistant Examiner*—Kim Lockett
(74) *Attorney, Agent, or Firm*—Crowell & Moring LLP

(57) ABSTRACT

There is disclosed a fallboard arrangement for a keyboard instrument, which has a construction facilitating operations of mounting and dismounting a fallboard as well as an operation of adjusting the length of a rotary shaft of the fallboard, and makes it possible to enhance the degree of freedom in designing the fallboard. A fallboard mounted to a body of an electronic piano opens and closes a performance section of the electronic piano. A rotary shaft extending in a left-right direction is rotatably mounted to the fallboard such that the rotary shaft can be axially lengthened and shortened. A pair of left and right pinions are arranged at left and right ends of the rotary shaft, respectively, such that the pair of left and right pinions and the rotary shaft form a one-piece assembly. The pair of left and right pinions are engaged with a pair of racks formed on arms of the piano body and extending in the front-rear direction at locations outward of respective left and right ends of the fallboard. Further, on the respective arms of the piano body, there are arranged a pair of rear guide rails extending along the respective racks in the front-rear direction at locations outward of the respective left and right ends of the fallboard, and the respective left and right ends of the rotary shaft are engaged with guide grooves of the guide rails, respectively. The rear guide rails guide these left and right ends when the fallboard is slid in the front-rear direction.

10 Claims, 11 Drawing Sheets

FALLBOARD ARRANGEMENT FOR KEYBOARD INSTRUMENT

BACKGROUND OF THE INVENTION

1. Field of the Invention

This invention relates to a fallboard arrangement for a keyboard instrument, such as an electronic piano, for opening and closing a performance section, including a keyboard, of the keyboard instrument, by sliding a fallboard thereof in a front-rear direction.

2. Description of the Prior Art

FIG. 10 shows a conventional fallboard arrangement of the above-mentioned kind. The fallboard arrangement 50 is applied to an electronic piano 60 and includes a fallboard 51. The fallboard 51 is mounted to a piano body 61 such that it can slide in a front-rear direction between a closed position (indicated by solid lines in FIG. 10) for closing a performance section of the electronic piano 60 and an open position (indicated by two-dot chain lines in the figure) for opening the same.

As shown in FIGS. 11A, 11B, the fallboard 51 includes a fallboard main section 52 in the form of a rectangular plate which is long sideways i.e. in a left-right direction, as well as a fallboard front section 53 and a fallboard rear section 54 which are also long sideways. The fallboard front and rear sections 53, 54 are fastened to the respective front and rear ends of the fallboard main section 52 by screws. The fallboard front section 53 has left and right front projections 53*a*, 53*a* outwardly projecting leftward and rightward from respective lower left and right corners thereof.

On the other hand, as shown in FIGS. 12A, 12B, the fallboard rear section 54 has a lower end to which a rotary shaft 55 is rotatably mounted. The rotary shaft 55 has left and right end portions fitted with respective left and right gear members 56. Each of the gear members 56 is a unitary member comprised of a rear projection 56*a*, a pinion 56*b*, and so forth, which are arranged in line in the mentioned order from the outside and integrally formed with each other. The gear member 56 is fixed to the rotary shaft 55 by a screw 57 screwed into the rotary shaft 55 through a slot 56*c* formed through the gear member 56.

The piano body 61 has left and right arms 61*a*, 61*a* to which left and right front guide rails 62, 62 and left and right rear guide rails 63, 63 are attached, respectively. Each front guide rail 62 extends forward and downward along a corresponding one of the arms 61*a*. The front guide rail 62 is formed with a front guide groove 62*a* extending over the whole length thereof. The front projection 53*a* is slidably engaged with the front guide groove 62*a*.

On the other hand, each of the rear guide rails 63 extends along a corresponding one of the arms 61*a* in the front-rear direction. The rear guide rail 63 includes a rear guide groove 63*a* and a rack 63*b* integrally formed with each other. The rear guide groove 63*a* and the rack 63*b* each extend over the whole length of the rear guide rail 63 in a manner forming a slightly upwardly curved arcuate shape, not shown. The rear projection 56*a* is slidably engaged with the rear guide groove 63*a*, and the pinion 56*b* is meshed with the rack 63*b*. Further, in plan view, the left and right ends of the fallboard 51 overlap the respective racks 63*b*, 63*b* (see FIG. 10).

Thus, when the fallboard 51 is drawn forward or pushed rearward, the front projections 53*a* are guided by the respective front guide rails 62, and the rear projections 56*a* by the respective rear guide rails 63, while the pinions 56*b* in mesh with the respective racks 63*b* rotate, whereby the fallboard 51 is moved in the front-rear direction without turning sideways with respect to the piano body 61.

During assembly of the electronic piano 60, the length of the rotary shaft 55 in the direction of width of space between the arms 61*a*, 61*a* is adjusted according to an actual distance between the arms 61*a*, 61*a* so as to place the gear members 56, 56 in engagement with the respective left and right rear guide grooves 63*a*, 63*a* in a proper positional relationship. More specifically, a proper position of each gear member 56 for engagement with the corresponding rear guide groove 63*a* is located by shifting the gear member 56 with respect to the rotary shaft 55 in the left-right direction. Then, when the proper position is located, the gear member 56 is fixed to the rotary shaft 55 by the screw 57. On the other hand, when the fallboard 51 is required to be dismounted from the piano body 61 e.g. for maintenance of the electronic piano 60, the screws 57 are turned and loosened, and then the gear members 56 are each shifted inward by relatively sliding the screw 57 along the slot 56*c*. As a result, the rotary shaft 55 including the left and right gear members 56 is shortened and thereby dismounted from the rear guide rails 63. Then, the front projections 53*a*, 53*a* are each disengaged from the corresponding front guide rail 62 via an opening of the rear end of the front guide rail 62. Thus, the fallboard 51 is dismounted from the piano body 61. Thereafter, when the fallboard 51 is mounted to the piano body 61 again, the mounting operation is carried out by the reverse of the above procedure, and at the same time, the rotary shaft 55 is adjusted in length.

In the above conventional fallboard arrangement 50, however, in order to mount the fallboard 51 to the piano body 61 during assembly of the electronic piano 60 or to dismount the fallboard 51 from the piano body 61 e.g. for maintenance of the electronic piano 60, as well as in order to adjust the length of the rotary shaft 55 in the direction of width of the space, it is required to lengthen or shorten the rotary shaft 55 by turning and loosening the screws 57, 57 provided at the respective left and right end portions of the rotary shaft 55 and then axially moving the gear members 56, 56 also fitted on the respective left and right end portions of the rotary shaft 55, which is troublesome and laborious. Further, since the racks 63*b*, 63*b* each form an upwardly curved arcuate shape and the left and right ends of the fallboard 51 overlap the respective left and right racks 63*b*, 63*b* in plan view, if the thickness of the fallboard main section 52 is increased e.g. due to design change of the fallboard 51, the bottom surfaces of the portions of the fallboard 51 overlapping the respective racks 63*b* are caught in the racks 63*b* during sliding of the fallboard 51. Even when the thickness of the fallboard main section 52 is not increased, if the racks 63*b* are designed to extend rearward and downward particularly with a view to preventing the fallboard 51 from being closed by its own weight during its opening or closing operation, the bottom surfaces of the portions of the fallboard 51 overlapping the respective racks 63*b* can be caught in the racks 63*b* similarly to the above case. In the conventional fallboard arrangement 50, as is apparent e.g. from the above fact that it is impossible to increase the thickness of the fallboard main section 52, the degree of freedom in designing the fallboard 51 is low.

SUMMARY OF THE INVENTION

It is an object of the invention to provide a fallboard arrangement for a keyboard instrument, which has a construction facilitating operations of mounting and dismounting a fallboard as well as an operation of adjusting the length of a rotary shaft of the fallboard, and makes it possible to enhance the degree of freedom in designing the fallboard.

To attain the above object, the present invention provides a fallboard arrangement for a keyboard instrument, for opening and closing a performance section including a keyboard and arranged within a body of the keyboard instrument, by being slid in a front-rear direction.

The fallboard arrangement according to the invention is characterized by comprising:

a fallboard mounted to the body of the keyboard instrument, for opening and closing the performance section;

a rotary shaft extending in a left-right direction and rotatably mounted to the fallboard such that the rotary shaft can be axially lengthened and shortened;

a pair of left and right pinions arranged at respective left and right ends of the rotary shaft such that the pair of left and right pinions and the rotary shaft form a one-piece assembly;

a pair of racks arranged in the body of the keyboard instrument and extending in the front-rear direction at respective locations outward of left and right ends of the fallboard, the pinions being meshed with the pair of racks, respectively; and a pair of guides arranged in the body of the keyboard instrument such that the pair of guides extend along the pair of racks in the front-rear direction at respective locations outward of the left and right ends of the fallboard, the pair of guides having a pair of guide grooves for being engaged with the left and right ends of the rotary shaft, respectively, and thereby guiding the fallboard to slide in the front-rear direction.

According to this fallboard arrangement for a keyboard instrument, the performance section is opened and closed by sliding the fallboard in the front-rear direction. When the fallboard is slid, the left and right ends of the rotary shaft are guided by the guide grooves of the pair of guides, and the pair of pinions in mesh with the pair of racks are rotated. As a result, the left and right ends of the rotary shaft travel an identical distance, so that even when the fallboard is opened or closed by being drawn or pushed by a force biased toward one side, the fallboard is smoothly slid in the front-rear direction without turning sideways with respect to the piano body, which enables smooth opening and closing of the fallboard. Further, since the rotary shaft can be shortened or lengthened, it is possible to disengage the pinions from the racks, and the left and right ends of the rotary shaft from the guide grooves, by shortening the rotary shaft. This makes it possible to mount or dismount the fallboard to or from the piano body or adjust the length of the rotary shaft. Moreover, at respective locations outward of the left and right ends of the fallboard, the pinions are meshed with the racks, and the left and right ends of the rotary shaft are engaged with the pair of guide grooves, so that differently from the conventional fallboard arrangement, the left and right ends of the fallboard do not overlap the racks and guides in plan view. This construction prevents the fallboard from interfering with the racks or the guides even when the thickness of the fallboard is changed or when the racks are formed in a manner extending rearward and downward, and hence it is possible to enhance the degree of freedom in designing the fallboard. It should be noted that in the present specification, a member, including a pin wheel, which is meshed with the rack and rotated is referred to as "the pinion".

Preferably, the rotary shaft includes two shaft members disposed along an axis of the rotary shaft and movable along the axis relative to each other, and a fixing element arranged in a central portion of the rotary shaft, for fixing the two shaft members at respective positions to which the shaft members are moved relative to each other.

According to this preferred embodiment, it is possible to lengthen or shorten the rotary shaft by releasing the two shaft members fixed to each other by the fixing element, from the fixed state, through operations effected on the central portion of the rotary shaft, and axially moving the shaft members relative to each other. Further, by fixing the shaft members with respect to each other at the positions to which the shaft members have been relatively moved, it is possible to adjust the length of the rotary shaft. Thus, the operations for mounting and dismounting the fallboard as well as the operation for adjusting the length of the rotary shaft can be carried out on the central portion of the rotary shaft, and hence these operations are easy to carry out, differently from the prior art.

Preferably, the two shaft members are each formed by a hollow member having open opposite ends, and the fixing element comprises a connecting rod for being inserted into an inner one of the open opposite ends of each the follow member, a slot formed in each the hollow member, and screws for each being screwed through the slot into the connecting rod.

More preferably, the left and right ends of the rotary shaft and the pair of left and right pinions are integrally formed, together with a pair of rollers, and a pair of insertion portions, to form a pair of gear members, respectively, and the body of the keyboard instrument is formed with a pair of rolling contact surfaces at respective location inward of the pair of racks, for allowing the pair of rollers to be in rolling contact therewith, the pair of insertion portions being each inserted into the inner one of the open opposite ends of the hollow member corresponding thereto.

Further preferably, the fallboard arrangement includes a pair of guide rails attached to the body of the keyboard instrument, and the pair of racks, the pair of guides, and the pair of rolling contact surfaces are integrally formed on the pair of guide rails, respectively.

Further preferably, the two shaft members and the connecting rod are made of metal, and the pair of gear members are made of a synthetic resin.

Still more preferably, the pair of gear members each have a core rod made of metal and coaxially embedded therein.

Preferably, the body of the keyboard instrument includes a pair of arms each extending in the front-rear direction and having an inner surface, and the pair of racks and the pair of guides are each arranged in the inner surface of a corresponding one of the pair of arms.

Preferably, the fallboard has a rear end, and a front end having left and right end portions, the rotary shaft being mounted to the fallboard along the rear end thereof, the body of the keyboard instrument being formed with a second pair of guide grooves corresponding to the pair of guide grooves, respectively, the fallboard having a pair of pins provided thereon such that the pair of pins extend outwardly in a left-right direction from the left and right end portions of the front end of the fallboard, respectively, for being engaged with the second pair of guide grooves.

More preferably, the fallboard includes a fallboard main section, and a fallboard front section, the fallboard front section having a lower end having left and right end portions, and the pair of pins are arranged at the left and right end portions of the lower end of the fallboard front section.

The above and other objects, features, and advantages of the invention will become more apparent from the following detailed description taken in conjunction with the accompanying drawings.

DETAILED DESCRIPTION OF A PREFERRED EMBODIMENT

The invention will now be described in detail with reference to the drawings showing a fallboard arrangement for a keyboard instrument, according to an embodiment thereof.

Figure 1:
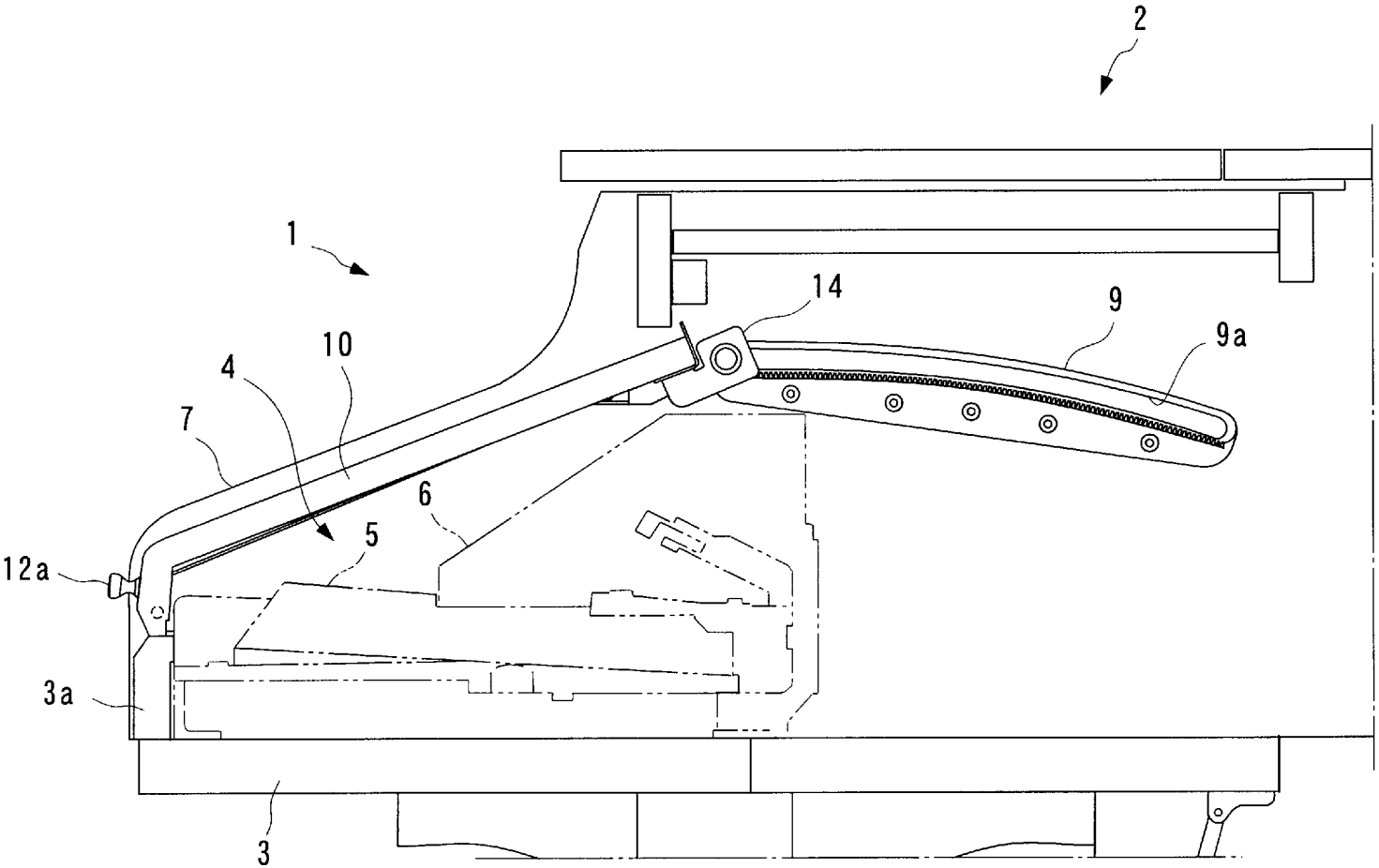
FIG. 1 is a sectional side elevation of an electronic piano to which is applied a fallboard arrangement according to an embodiment of the present invention, in a state of a fallboard thereof being closed.
Figure 2:
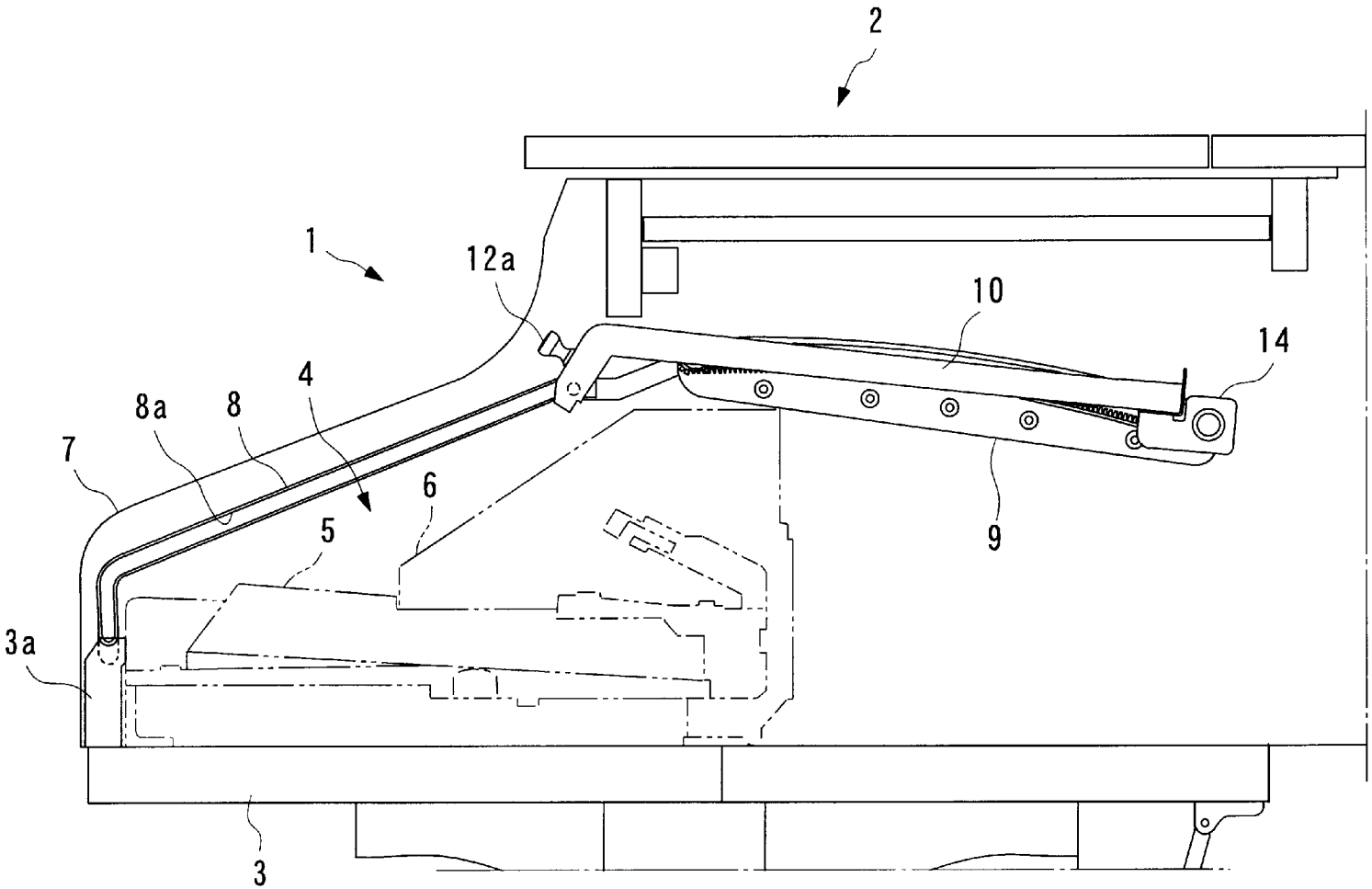
FIG. 2 is a sectional side elevation of the FIG. 1 electronic piano in a state of the fallboard thereof being open.
Figure 3:
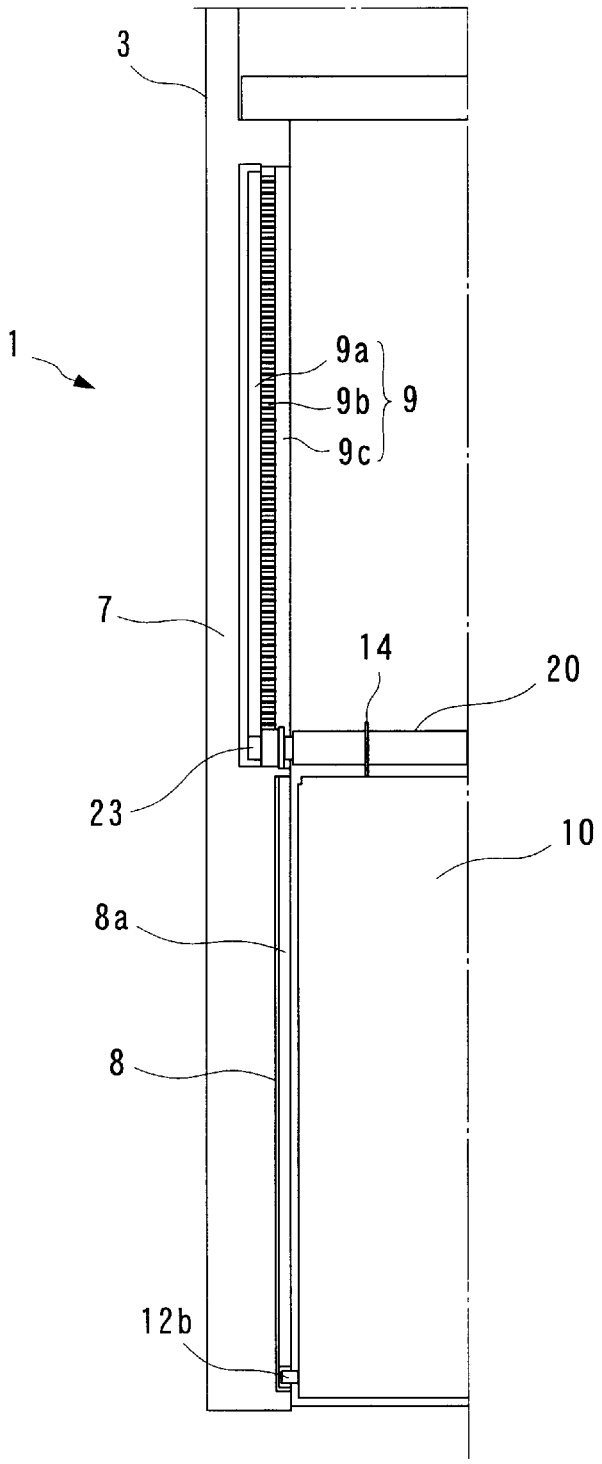
FIG. 3 is a partially-cutaway plan view of the fallboard arrangement.

FIGS. 1 to 3 show an electronic piano (keyboard instrument) to which the fallboard arrangement according to the invention is applied. The electronic piano is of a grand type, not shown, and includes a piano body (body of the keyboard instrument) 3, and the fallboard arrangement 1 having a fallboard 10 for opening and closing a performance section 4 of the piano body 3. The piano body 3 is an assembly of plywood members, steel members, and so forth, and includes left and right arms 7, 7 (only one of them is shown in the figure) each extending in the front-rear direction. In the performance section 4 between the left and right arms 7, 7, there are arranged a keyboard 5, an operation panel 6, and so forth.

Each of the left and right arms 7, 7 has an inner surface thereof formed with front and rear grooves each extending in the front-rear direction. A front guide rail 8 and a rear guide rail 9 are fitted in the front and rear grooves, respectively. The left front and rear guide rails 8, 9 and the right front and rear guide rails 8, 9 are symmetrically opposed to each other.

Each front guide rail 8 extends vertically upward from the vicinity of an upper left or right corner of a keyslip 3*a* along the inner surface of the arm 7, then extends obliquely upward and rearward toward the front end of the rear guide rail 9, and finally extends horizontally rearward, i.e. in the front-rear direction. The front guide rails 8 are each formed by a resin molded article having an inwardly open U-shape in cross section. The open portion of each front guide rail 8 serves as a front guide groove 8*a*. The front guide groove 8*a* extends over the whole length of the front guide rail 8 and has an open rear end. The front guide rail 8 is fastened to the arm 7 by screws such that the inner ends thereof are flush with the inner surface of the arm 7.

Figure 4:
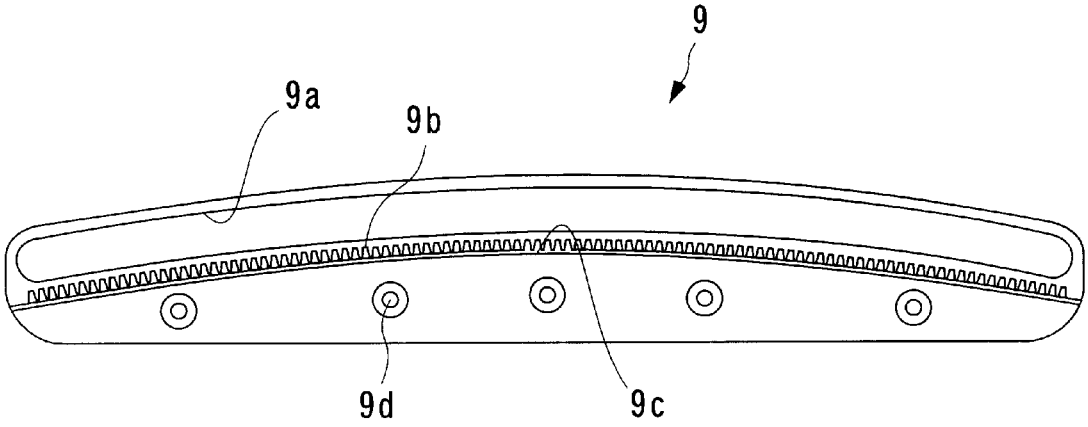
FIG. 4 is a side view of a rear guide rail.

On the other hand, each rear guide rail (guide) 9 is mounted in a manner extending over a long distance in the front-rear direction as best shown in FIG. 4. The rear guide rail 9 is formed with a rear guide groove 9*a*, a rack 9*b*, and a rolling contact surface 9*c*. The rear guide groove 9*a*, the rack 9*b*, and the rolling contact surface 9*c* are arranged in the mentioned order from the outside and integrally formed with each other. Further, these three portions 9*a*, 9*b*, 9*c* each extend over the whole length of the rear guide rail 9 in the front-rear direction in a manner forming a slightly upwardly curved arcuate shape, and arranged such that the front end of the arcuate shape is higher in level than the rear end thereof. The rear guide groove 9*a* has front and rear ends thereof closed so as to prevent projections 23*a,* referred to hereinafter, from falling out therefrom.

Figure 9:
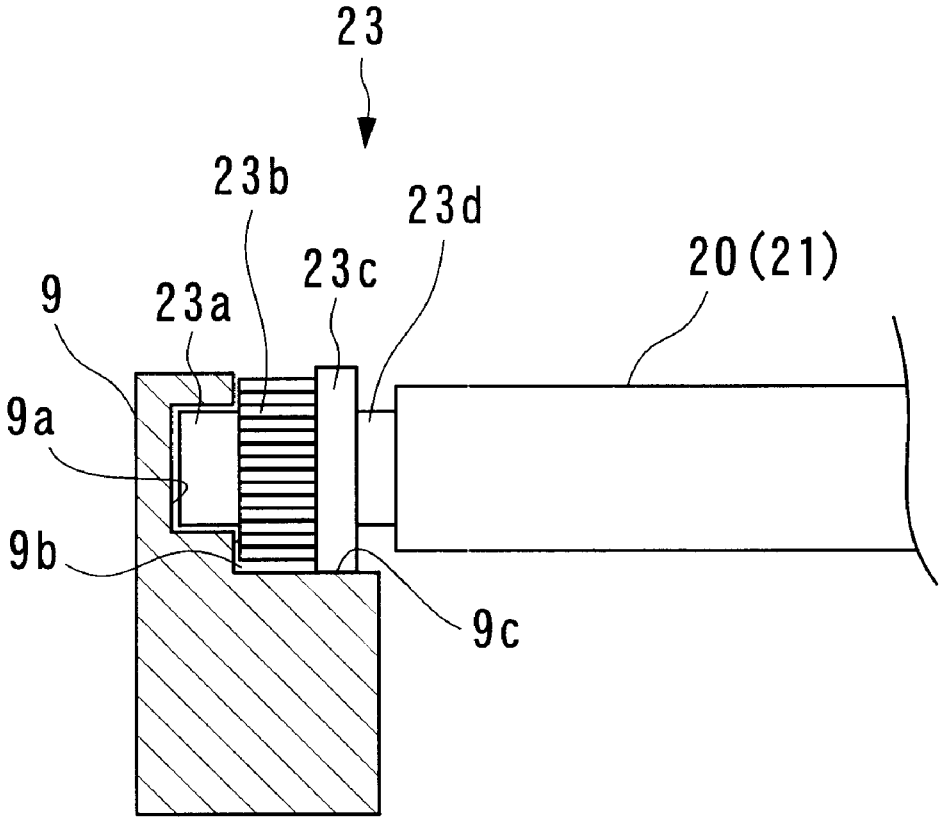
FIG. 9 is a partially-cutaway front view showing a gear member of the rotary shaft and the rear guide rail.
Figure 10:
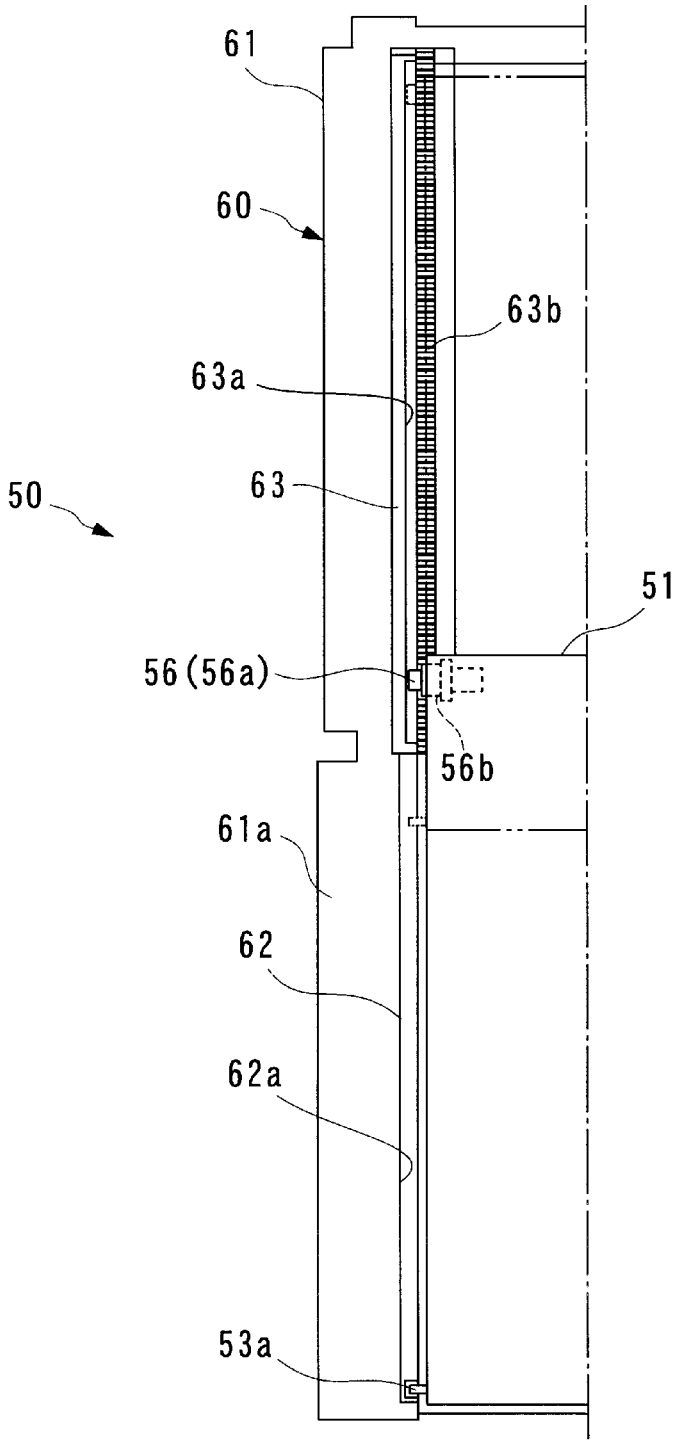
FIG. 10 PRIOR ART
FIG. 10 is a partially-cutaway plan view of a conventional fallboard arrangement.
Figure 11A:
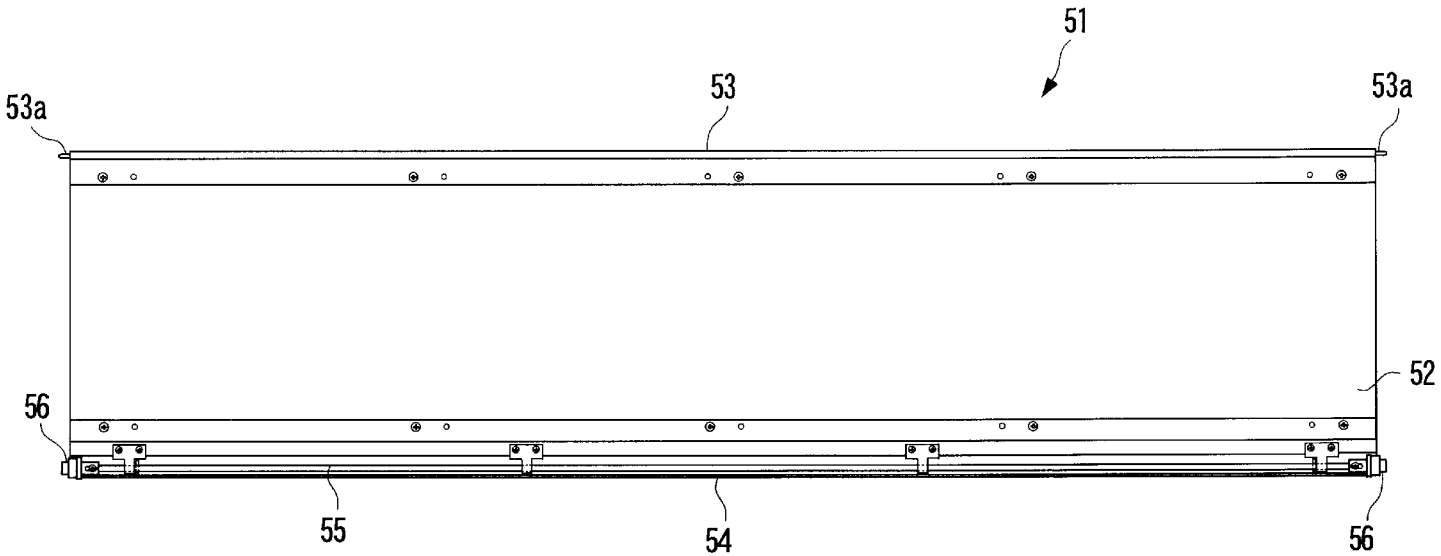
FIG. 11A PRIOR ART
FIG. 11A is a bottom view of a fallboard of the conventional fallboard arrangement.
Figure 11B:
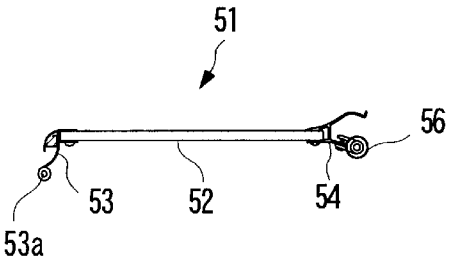
FIG. 11B PRIOR ART
FIG. 11B is a side view of the conventional fallboard.
Figure 12A:
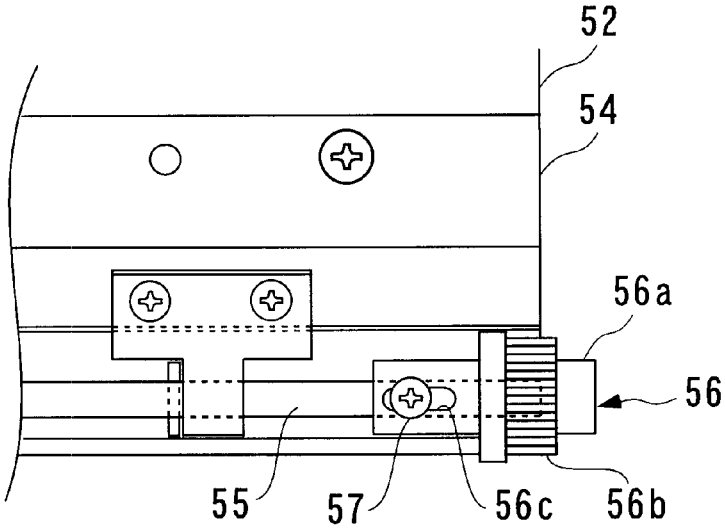
FIG. 12A PRIOR ART
FIG. 12A is an enlarged view showing an essential portion of FIG. 11A.
Figure 12B:
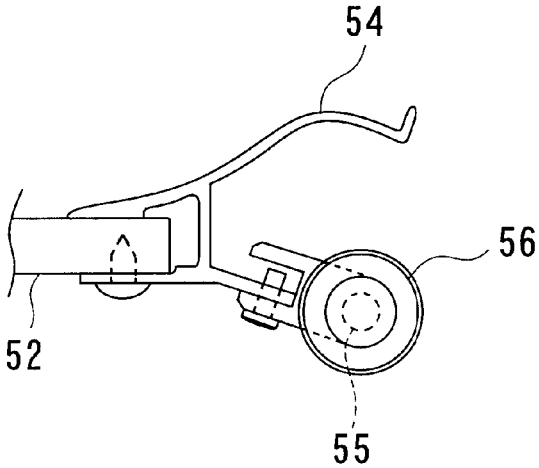
FIG. 12B PRIOR ART
FIG. 12B is an enlarged view showing an essential portion of FIG. 11B.

The rear guide groove (guide groove) 9*a* is rectangular in cross section and open inwardly (see FIG. 9). The rack 9*b* is disposed at a location slightly downward of the bottom surface of the rear guide groove 9*a*, and the rolling contact surface 9*c* is disposed at a location slightly downward of sawteeth of the rack 9*b*.

Further, at a location downward of the rolling contact surface 9*c* of the rear guide rail 9, there are formed five through holes 9*d* in a manner spaced from each other in the front-rear direction. The through holes 9*d* extend through the rear guide rail 9 in the left-right direction, and the rear guide rail 9 is fixed to the arm 7 by screws, not shown, which are screwed in the arm 7 through the respective through holes 9*d*.

Figure 5A:
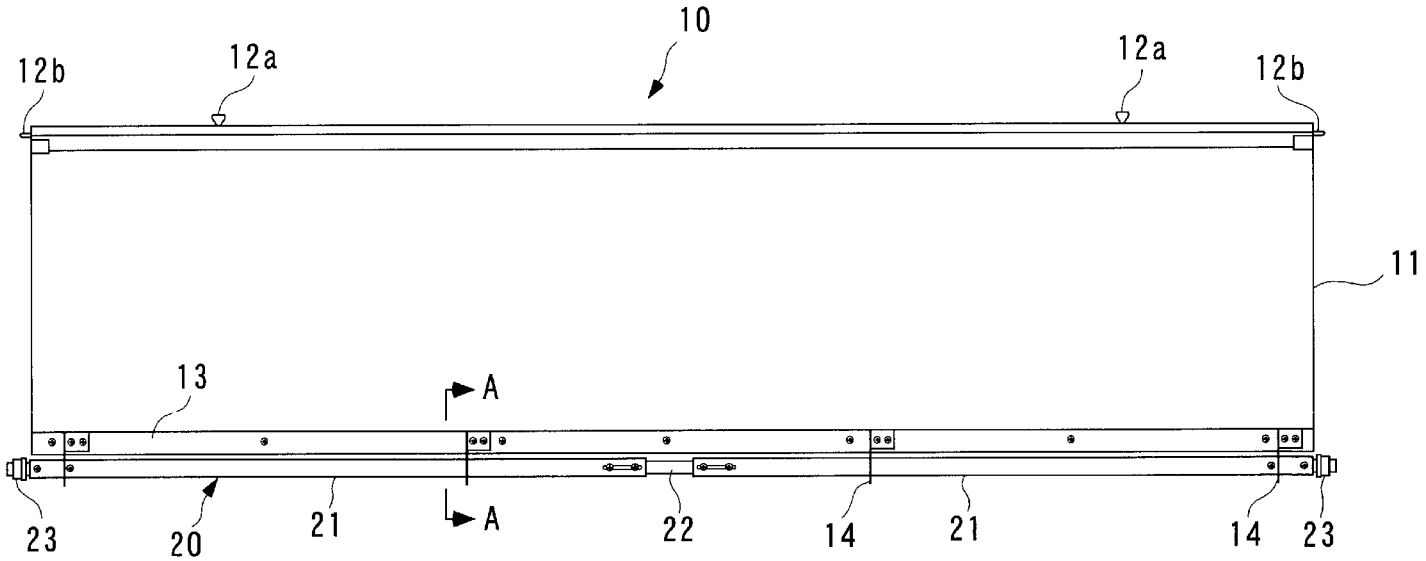
FIG. 5A is a bottom view of a fallboard.
Figure 5B:
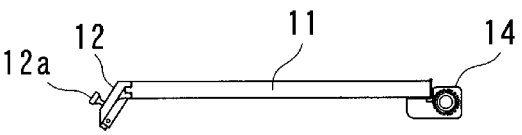
FIG. 5B is a side view of the fallboard.

The fallboard 10 is mounted to the piano body 3 in a manner slidable in the front-rear direction between a closed position for closing the performance section 4 as shown in FIG. 1 and an open position for opening the same as shown in FIG. 2. As shown in FIGS. 5A, 5B, the fallboard 10 includes a fallboard main section 11, a fallboard front section 12, a metal fitting 13, a shaft support 14, and a rotary shaft 20. The fallboard main section 11 is formed by a rectangular board (e.g. a plywood board) which is long sideways, i.e. in the left-right direction and coated with paint. The fallboard main section 11 has a width (length in the left-right direction) which is slightly smaller than the distance between the inner surfaces of the left and right arms 7, 7 and a depth (length in the front-rear direction) which is large enough to cover the performance section 4 together with the fallboard front section 12.

The fallboard front section 12 is formed by an elongated board strip (e.g. a strip of solid wood board) which is coated with paint, and has an identical width to that of the fallboard main section 11. The fallboard front section 12 is secured to the front end of the fallboard main section 11, and the lower end of the fallboard front section 12 is held in contact with the keyslip 3*a* when the fallboard 10 is in its closed position for covering the performance section 4. The fallboard front section 12 has a pair of left and right knobs 12*a,* 12*a* attached to the outer surface thereof at respective locations and a pair of left and right pins 12*b,* 12*b* projecting outward from the lower left and right corners thereof, respectively. The knobs 12*a,* 12*a* are for being held with both hands, for opening and closing the fallboard 10.

The pair of left and right pins 12*b,* 12*b* are each formed by a metal piece (formed e.g. of steel) circular in cross section. The left and right pins 12*b,* 12*b* are fitted in the respective front guide grooves 8*a*, 8*a* of the left and right front guide rails 8, 8. The portion of each pin 12*b* projecting outward from the fallboard front section 12 has a sufficient length for preventing the pin 12*b* from falling out from the front guide groove 8*a* when the fallboard main section 11 are displaced leftward or rightward. Thus, when the fallboard 10 is drawn or pushed by hand, the fallboard 10 moves in the front-rear direction while being guided by the front guide grooves 8*a* without falling out from the same.

The metal fitting 13 is formed by a relatively thin elongated metal plate strip (e.g. a steel plate) having an L-shape in cross section and has an identical width to that of the fallboard main section 11. The metal fitting 13 is fastened to the fallboard main section 11 by screws, in contact with the rear end surface and the bottom surface of the fallboard main section 11.

Figure 6:
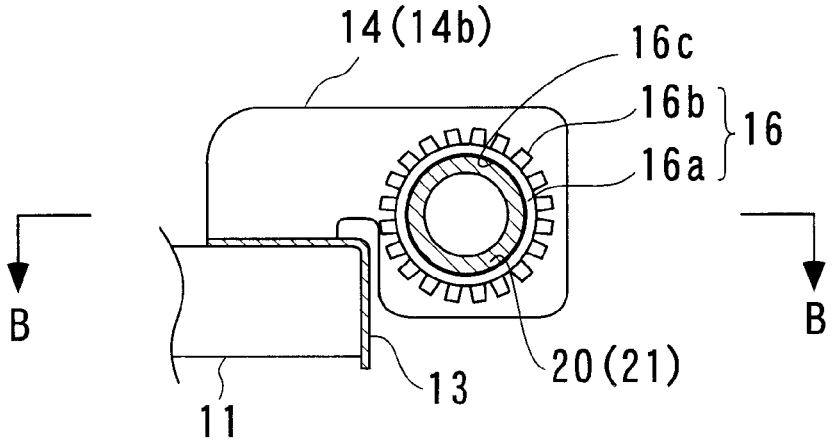
FIG. 6 is a sectional view taken on line A—A of FIG. 5A.
Figure 7:
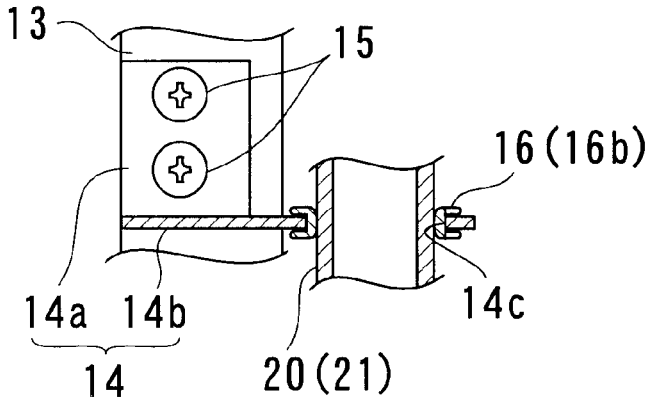
FIG. 7 is a sectional view taken on line B—B of FIG. 6.

Further, the four shaft supports 14 are mounted to the fallboard main section 11. The four shaft supports 14 are arranged at equally spaced intervals in the left-right direction, and two of them are disposed in the respective left and right corner portions of the fallboard main section 11. As shown in FIGS. 6 and 7, each shaft support 14 is formed by stamping and bending a relatively thin metal plate (e.g. a steel plate) such that it has a mounting portion 14*a* and a shaft support portion 14*b* formed integrally with each other and extending at right angles to each other. The mounting portion 14*a* which is rectangular in shape is fixed by two screws 15, 15 to the fallboard main section 11 together with the metal fitting 13 in a state in contact with the top or exposed surface of the metal fitting 13.

The shaft support portion 14*b* is continuous with the left end (lower end as viewed in FIG. 7) of the mounting portion 14*a* and extends rearward (rightward as viewed in FIG. 7). The shaft support portion 14*b* has a rearward half portion thereof projecting rearward of the fallboard main section 11 and extending upward (FIG. 6 shows the shaft support 4 and its associated components upside down). The rearward half portion of the shaft support portion 14*b* is formed to have a larger height than that of the forward half portion of the same and formed therethrough with a round through hole 14*c* extending in the left-right direction. A shaft support ring 16 is fitted in the round through hole 14*c*.

The shaft support ring 16 is formed of a synthetic resin having lubricity. The shaft support ring 16 is comprised of an annular base portion 16*a* and a plurality of left and right holder portions 16*b* integrally formed with the base portion 16*a*. The left and right holder portions 16*b* are formed along the circumference of the base portion 16*a* at equal intervals in a manner continuous with the respective left and right ends of the base portion 16*a* and extending radially outward therefrom. The shaft support ring 16 is mounted in the shaft support 14 with the base portion 16*a* fitted in the round through hole 14*c* and the plurality of left and right holder portions 16*b*, 16*b* sandwiching the rim of the round through hole 14*c* therebetween.

Figure 8:
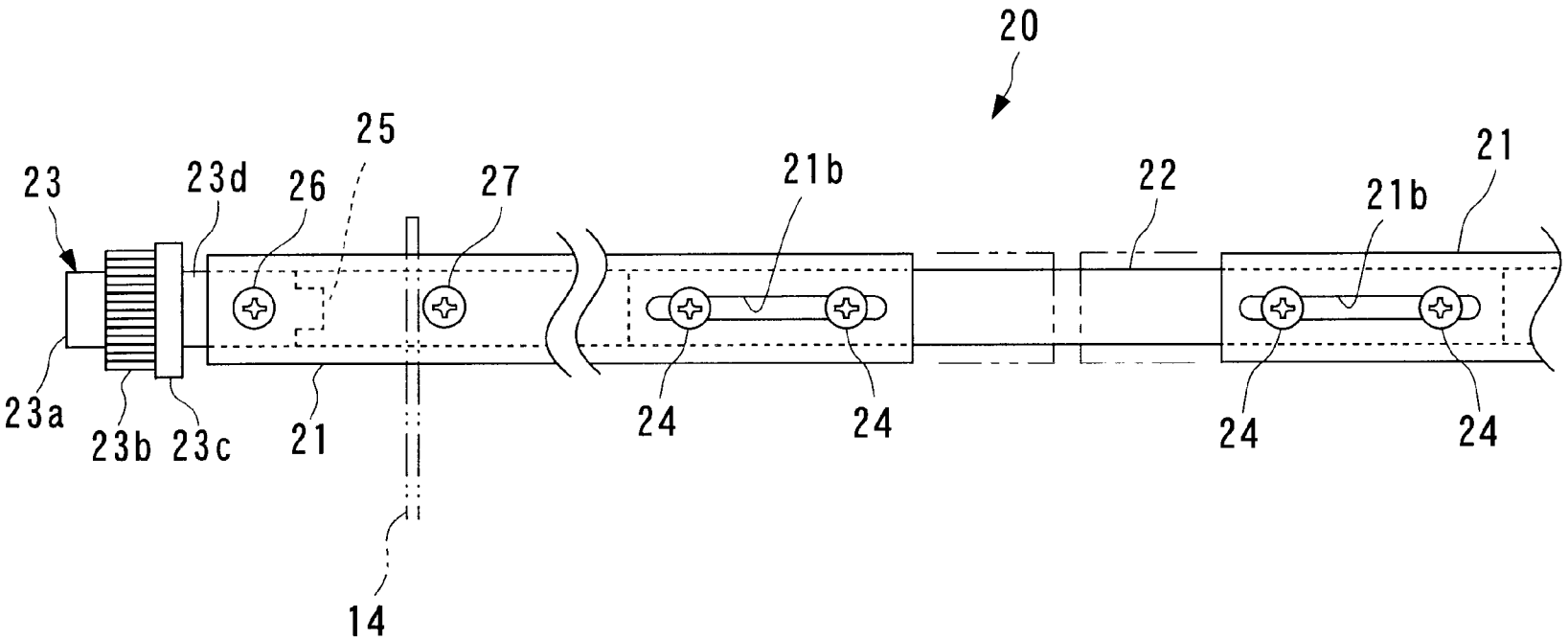
FIG. 8 is a plan view of a rotary shaft of the fallboard.

The rotary shaft 20 extends through the holes 16*c* of the shaft support rings 16 of the four shaft supports 14 in a manner rotatably supported by the shaft supports 14. As shown in FIG. 8, the rotary shaft 20 is comprised of a pair of left and right shaft members 21, 21 disposed along the axis of the rotary shaft 20, a connecting rod 22 connecting the inner end portions (hereinafter referred to as "the connecting end portions") of the respective shaft members 21, 21, and a pair of left and right gear members 23, 23 mounted to the respective outer end portions (hereinafter referred to as "the mounting end portions") of the shaft members 21,21. The rotary shaft 20 is symmetrical in construction with respect to an imaginary center plane perpendicular to the axis of the shaft 20.

The shaft members 21 are each formed by a hollow cylindrical metal (e.g. aluminum alloy) pipe extending in the left-right direction and having open opposite ends. Each shaft member 21 has an outer diameter slightly smaller than the diameter of the hole 16*c* of each shaft support 16 and extends through the holes 16*c* of two shaft supports 14 in a manner rotatably supported by the two shaft supports 14. Further, the connecting end portion of each shaft member 21 is formed with a slot 21*b* extending in the left-right direction.

The connecting rod (fixing element) 22 is formed by a solid cylindrical rod which is identical in material to the shaft members 21. The connecting rod 22 has an outer diameter slightly smaller than the inner diameter of each shaft member 21 and is inserted in the connecting portions of the shaft members 21, 21. The connecting rod 22 is formed with left and right pairs of screw holes, not shown, and two length-adjusting screws (fixing elements) 24, 24 are screwed in each pair of screw holes, respectively, via the slot 21*b* of a corresponding one of the shaft members 21 until they are tightened. Thus, the shaft members 21, 21 and the connecting rod 22 are fastened to each other to form a one-piece assembly.

The gear members 23 are each formed of a synthetic resin and comprised of a projection 23*a*, a pinion 23*b*, a roller 23*c*, and an insertion portion 23*d* which are arranged in line concentric with each other in the mentioned order from the outside and integrally formed with each other. The projection 23*a* is circular in cross section and engaged with the rear guide groove 9*a* of the rear guide rail 9 as shown in FIG. 9. The pinion 23*b* is larger in diameter than the projection 23*a* and engaged i.e. meshed with the rack 9*b*. The roller 23*c* is circular in cross section and larger in diameter than the pinion 23*b*, and is held in contact with the rolling contact surface 9*c*.

Further, the insertion portion 23*d* is circular in cross section and inserted in the mounting end portion of the shaft member 21. A core rod 25 is coaxially embedded in the gear member 23. The core rod 25 is formed of a metal and projects inwardly from the insertion portion 23*d*.

At predetermined locations in the mounting end portion of the shaft member 21, there are fitted a connecting screw 26 and a control screw 27, respectively, in a manner spaced from each other in the axial direction. The connecting screw 26 is disposed at a location outward of the control screw 27 and screwed in a screw hole, not shown, formed in the core rod 25, via holes, not shown, formed respectively through the shaft member 21 and the insertion portion 23*d*, until they are tightened, whereby the gear member 23 is fastened to the shaft member 21 to form a one-piece assembly.

The control screws 27 inhibit displacement of the rotary shaft 20 in the left-right direction with respect to the fallboard 10. For this purpose, the left and right control screws 27, 27 are each disposed at a location close to the inner side of a corresponding one of the shaft supports 14, 14 arranged in the respective left and right corner portions of the fallboard 10, and fitted in a corresponding one of the left and right shaft members 21, 21. Thus, the rotary shaft 20 is restricted in position such that the left and right portions thereof project outward from the fallboard 10 by a substantially identical length.

In the fallboard arrangement 1 constructed as above, when the fallboard 10 is to be opened, the knobs 12*a*, 12*a* are held by both hands, and the fallboard 10 is lifted upward and pushed rearward from its closed position (shown in FIG. 1). By this operation, the pins 12*b* and the projections 23*a* are guided by the respective front and rear guide grooves 8*a*, 9*a*, while the pinions 23*b* in mesh with the respective racks 9*b* are rotated, and the rollers 23*c* roll on the respective rolling contact surfaces 9*c,* whereby the fallboard 10 is slid rearward to be opened.

On the other hand, the fallboard 10 can be closed by the reverse of the above opening procedure, i.e. by pulling the knobs 12*a,* 12*a* and thereby sliding the fallboard 10 forward. As described above, in the opening/closing operations of the fallboard 10, each pinion 23*b* in mesh with the rack 9*b* is rotated, thereby causing the left and right ends of the fallboard 10 to travel an identical distance. Therefore, even when the fallboard 10 is opened or closed by being drawn or pushed by a force biased toward one side, e.g. by holding only one of the knobs 12*a,* the fallboard is slid in the front-rear direction without turning sideways with respect to the piano body 3, which enables smooth opening and closing of the fallboard 10. Further, since the rear guide grooves 9*a* of the rear guide rails 9 and the racks 9*b* each extend rearward and downward, the fallboard 10 can be held in the open position. Moreover, during the closing operation for drawing the fallboard 10 from its open position, this construction inhibits the fallboard 10 from being closed by its own weight before being slid close to its closed position, thereby preventing the fallboard 10 from abutting or striking against the keyslip 3*a* by accident.

Next, description will be made of operations for mounting the fallboard arrangement 1 to the piano body 3 during assembly of the electronic piano 2.

First, the front and rear guide rails 8, 9 are fitted in the respective grooves formed in the arms 7 and fastened to the arms 7 by screws. At the same time, the rotary shaft 20 is mounted to the fallboard 10 in a state of only inner two of the four length-adjusting screws 24 being loosely screwed, and each shaft member 21 is slid inward by relatively sliding the screw 24 along the slot 21*b,* to thereby bring the rotary shaft into a shortened state (i.e. a state indicated by two-dot chain lines in FIG. 8).

Then, each pin 12*b* of the fallboard 10 is inserted from the open rear end of a corresponding one of the front guide rails 8 to be fitted in the front guide groove 8*a* of the front guide rails 8, and thereafter, the rotary shaft 20 is lengthened by sliding each shaft member 21 outward to thereby fit each projection 23*a* in the rear guide groove 9*a* of a corresponding one of the rear guide rails 9.

Subsequently, an operation of adjusting the length of the rotary shaft 20 in the direction of width of the space (in the left-right direction) is carried out. More specifically, the amount of projection of each of the left and right projections 23*a,* 23*a* of the rotary shaft 20 is finely adjusted by sliding the left and right shaft members 21, 21 in the left-right direction along the respective slots 21*b,* 21*b,* whereby the projections 23*a* are properly fitted in the respective rear guide grooves 9*a*, the pinions 23*b* are properly meshed with the respective racks 9*b*, and the rollers 23*c* are held in proper contact with the respective rolling contact surfaces 9*c*. Then, in this state of the rotary shaft 20 being properly adjusted in length, the inner two length-adjusting screws 24, 24 are tightened, and the outer two length-adjusting screws 24, 24 are inserted through the respective slots 21*b,* 21*b* and screwed in the connecting rod 22 until they are tightened. Thus, the fallboard 10 is mounted to the piano body 3 in a manner slidable along the front and rear guide rails 8, 9 in the front-rear direction.

On the other hand, when it is required to dismount the fallboard 10 from the piano body 3 e.g. for maintenance of the electronic piano 2, the fallboard 10 is dismounted by following the reverse of the mounting procedure described above. More specifically, the outer two of the four length-adjusting screws 24 are removed and the inner two are loosened, and in this state, the shaft members 21 are slid inward along the respective slots 21*b* to thereby shorten the length of the rotary shaft 20 and dismount the rotary shaft 20 from the left and right guide rails 9, 9. Then, the fallboard 10 is shifted rearward, and the pins 12*b,* 12*b* are pulled out from the open rear ends of the respective left and right front guide rails 8, 8, whereby the fallboard 10 is dismounted from the piano body 3. When the fallboard 10 is to be mounted again to the piano body 3, operations are carried out following the same procedure as the mounting procedure described above, and at the same time, the operation of adjusting the length of the rotary shaft 20 in the direction of length of the keyboard is also carried out. Thus, the fallboard 10 can be mounted to or dismounted from the piano body 3 following the above procedures.

As described above, according to the fallboard arrangement 1 of the present embodiment, by removing the outer two of the four length-adjusting screws 24 disposed in the central portion of the rotary shaft 20 and loosening the inner two, thereby releasing the left and right shaft members 21, 21 and the connecting rod 22 from the state fixed to each other, and moving the shaft members 21, 21 in the left-right direction along the respective slots 21*b,* it is possible to shorten the rotary shaft 20 and dismount the fallboard 10 from the piano body 3. Further, by reversing the procedure, it is possible to mount the fallboard 10 to the piano body 3. Moreover, by tightening the inner two or all of the four length-adjusting screws 24, it is possible to fasten the shaft members 21, 21 moved to respective proper positions and the connecting rod 22 to each other to form a one-piece assembly, and thereby adjust the length of the rotary shaft 20 as desired. In the embodiment of the present invention, as described above, the operations for mounting and dismounting the fallboard 10 as well as the operation for adjusting the length of the rotary shaft 20 can be carried out on the central portion of the rotary shaft 20, and hence these operations are easy to carry out, differently from the prior art.

Further, according to the present embodiment, the left and right ends of the fallboard 10 are positioned at respective locations inward of the inner ends of the respective left and right rear guide rails 9, 9, and at the same time, at respective locations outward of the left and right ends of the fallboard 10, the projections 23*a* are fitted in the rear guide rails 9*a*, the pinions 23*b* are engaged with the racks 9*b*, and the rollers 23*c* are held in contact with the rolling contact surfaces 9*c*. That is, differently from the conventional fallboard arrangement, the left and right ends of the fallboard 10 do not overlap the racks 9*b* and guide rails 9, respectively, in plan view. This construction prevents the fallboard 10 from interfering with the racks 9*b* or the guide rails 9 even when the racks 9*b* are formed in a manner extending rearward and downward as in the present embodiment or when the thickness of the fallboard 10 is changed in design. As a result, it is possible to enhance the degree of freedom in designing the fallboard 10.

It should be noted that pin wheels or any other suitable kind of gears may be used in place of the pinions 23*b* so long as they can be meshed with the racks 9*b* and rotated in unison with or while supporting the rotary shaft 20. Further, the rotary shaft 20 is not necessarily required to include the connecting rod 22, but the shaft members 21, 21 may be connected to each other directly. In this case, for instance, one of the shaft members 21 is constructed to have a connecting end portion thereof formed with a screw hole, and the other shaft member 21 is constructed to have a connecting end portion thereof formed with a slot. Further, the connecting end portion of the one shaft member 21 is formed to have a smaller diameter than that of the other portion thereof such that the connecting end portion can be inserted into the connecting end portion of the other shaft members 21, and a screw is screwed in the screw hole of the inserted connecting end portion via the slot formed in the connecting end portion of the other shaft member 21.

Moreover, members to which the front and rear guide rails 8, 9 are mounted are not limited to the arms 7, but they can be other suitable members or potions of the piano body 3. For instance, the front and rear guide rails 8, 9 may be mounted to the bottom surface of the topboard of the piano body 3 in a manner suspended therefrom. Alternatively, without using the guide rails 8. 9 as additional members, the front guide grooves 8*a*, the rear guide grooves 9*a*, the racks 9*b* and the rolling contact surfaces 9*c* may be formed directly on the arms 7, whereby the arms 7 per se may be used as guides.

It is further understood by those skilled in the art that the foregoing is a preferred embodiment of the invention, and that various changes and modifications may be made without departing from the spirit and scope thereof.

What is claimed is:

1. A fallboard arrangement for a keyboard instrument, for opening and closing a performance section including a keyboard and arranged within a body of said keyboard instrument, by being slid in a front-rear direction, the fallboard arrangement comprising:

a fallboard mounted to said body of said keyboard instrument, for opening and closing said performance section;

a rotary shaft extending in a left-right direction and rotatably mounted to said fallboard such that said rotary shaft can be axially lengthened and shortened;

a pair of left and right pinions arranged at respective left and right ends of said rotary shaft such that said pair of left and right pinions and said rotary shaft form a one-piece assembly;

a pair of racks arranged in said body of said keyboard instrument and extending in said front-rear direction at respective locations outward of left and right ends of said fallboard, said pinions being meshed with said pair of racks, respectively; and a pair of guides arranged in said body of said keyboard instrument such that said pair of guides extend along said pair of racks in said front-rear direction at respective locations outward of said left and right ends of said fallboard, said pair of guides having a pair of guide grooves for being engaged with said left and right ends of said rotary shaft, respectively, and thereby guiding said fallboard to slide in said front-rear direction.

2. A fallboard arrangement according to claim 1, wherein said rotary shaft includes two shaft members disposed along an axis of said rotary shaft and movable along said axis relative to each other, and a fixing element arranged in a central portion of said rotary shaft, for fixing said two shaft members at respective positions to which said shaft members are moved relative to each other.

3. A fallboard arrangement according to claim 1, wherein said two shaft members are each formed by a hollow member having open opposite ends, and wherein said fixing element comprises a connecting rod for being inserted into an inner one of said open opposite ends of each said follow member, a slot formed in each said hollow member, and screws for each being screwed through said slot into said connecting rod.

4. A fallboard arrangement according to claim 3, wherein said left and right ends of said rotary shaft and said pair of left and right pinions are integrally formed, together with a pair of rollers, and a pair of insertion portions, to form a pair of gear members, respectively, and wherein said body of said keyboard instrument is formed with a pair of rolling contact surfaces at respective locations inward of said pair of racks, for allowing said pair of rollers to be in rolling contact therewith, said pair of insertion portions being each inserted into said inner one of said open opposite ends of said hollow member corresponding thereto.

5. A fallboard arrangement according to claim 4, including a pair of guide rails attached to said body of said keyboard instrument, and wherein said pair of racks, said pair of guides, and said pair of rolling contact surfaces are integrally formed on said pair of guide rails, respectively.

6. A fallboard arrangement according to claim 4, wherein said two shaft members and said connecting rod are made of metal, and said pair of gear members are made of a synthetic resin.

7. A fallboard arrangement according to claim 6, wherein said pair of gear members each have a core rod made of metal and coaxially embedded therein.

8. A fallboard arrangement according to claim 1, wherein said body of said keyboard instrument includes a pair of arms each extending in said front-rear direction and having an inner surface, and wherein said pair of racks and said pair of guides are each arranged in said inner surface of a corresponding one of said pair of arms.

9. A fallboard arrangement according to claim 1, wherein said fallboard has a rear end, and a front end having left and right end portions, said rotary shaft being mounted to said fallboard along said rear end thereof, said body of said keyboard instrument being formed with a second pair of guide grooves corresponding to said pair of guide grooves, respectively, said fallboard having a pair of pins provided thereon such that said pair of pins extend outwardly in a left-right direction from said left and right end portions of said front end of said fallboard, respectively, for being engaged with said second pair of guide grooves.

10. A fallboard arrangement according to claim 9, wherein said fallboard includes a fallboard main section, and a fallboard front section, said fallboard front section having a lower end having left and right end portions, and wherein said pair of pins are arranged at said left and right end portions of said lower end of said fallboard front section.

* * * * *